US009168768B2

(12) United States Patent
Nonaka

(10) Patent No.: US 9,168,768 B2
(45) Date of Patent: Oct. 27, 2015

(54) PRINTING APPARATUS, CONTROL METHOD FOR PRINTING APPARATUS, AND STORAGE MEDIUM

(75) Inventor: Takashi Nonaka, Kunitachi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/460,173

(22) Filed: Apr. 30, 2012

(65) Prior Publication Data

US 2012/0288294 A1 Nov. 15, 2012

(30) Foreign Application Priority Data

May 12, 2011 (JP) ..... 2011-107011

(51) Int. Cl.

| | |
|---|---|
| ***G03G 21/00*** | (2006.01) |
| ***B65H 33/04*** | (2006.01) |
| ***B41J 13/00*** | (2006.01) |
| ***G03G 15/00*** | (2006.01) |
| ***B41J 11/48*** | (2006.01) |

(52) U.S. Cl.

CPC ..... *B41J 13/0036* (2013.01); *B41J 11/485* (2013.01); *G03G 15/655* (2013.01); *B65H 33/04* (2013.01); *G03G 2215/00894* (2013.01)

(58) Field of Classification Search

CPC ..... G03G 15/655; G03G 2215/00894; B65H 33/04

USPC ..... 399/382, 391; 270/58.32

See application file for complete search history.

(56) References Cited

U.S. PATENT DOCUMENTS

| | | | | |
|---|---|---|---|---|
| 7,577,396 | B2 * | 8/2009 | Kitano | 399/405 |
| 7,848,673 | B2 * | 12/2010 | Sakuraba et al. | 399/81 |
| 2008/0019726 | A1 | 1/2008 | Sakuraba | |
| 2008/0304850 | A1 * | 12/2008 | Groninger et al. | 399/88 |
| 2009/0251716 | A1 * | 10/2009 | Igarashi | 358/1.12 |
| 2009/0304430 | A1 * | 12/2009 | Vetromile et al. | 400/605 |

FOREIGN PATENT DOCUMENTS

| | | | |
|---|---|---|---|
| CN | 101551610 | A | 10/2009 |
| JP | 2003-122071 | A | 4/2003 |
| JP | 2003-195585 | A | 7/2003 |
| JP | 2003-345081 | A | 12/2003 |
| JP | 2005-089112 | A | 4/2005 |
| JP | 2006-248672 | A | 9/2006 |
| JP | 2007-076343 | A | 3/2007 |
| JP | 2009-222794 | A | 10/2009 |

* cited by examiner

*Primary Examiner* — Matthew G Marini
*Assistant Examiner* — John M Royston
(74) *Attorney, Agent, or Firm* — Canon USA, Inc. IP Division

(57) ABSTRACT

A method for controlling a printing apparatus includes printing, via a printing unit, an image on a sheet according to image data to generating one copy of printed product, conveying, among one set of a plurality of index sheets, a number of index sheets designated by a user, to add the designated number of sheets to the one copy of printed product generated by the printing unit, conveying, after conveying sheets corresponding to the one copy of printed product, remaining index sheets among the set of a plurality of index sheets to discharge the remaining index sheets, and conveying the index sheets to be added to the one copy of printed product at a first conveyance speed, and conveying the remaining index sheets at a second conveyance speed that is higher than the first conveyance speed.

7 Claims, 16 Drawing Sheets

PRINTING APPARATUS, CONTROL METHOD FOR PRINTING APPARATUS, AND STORAGE MEDIUM

BACKGROUND OF THE INVENTION

1. Field of the Invention

The present invention relates to a printing apparatus, a control method for a printing apparatus, and a storage medium.

2. Description of the Related Art

There is a printing apparatus which, in response to a demand from the printing market, is capable of handling various paper types. Such paper types include plain paper, recycled paper, and thin paper. Further, the paper types include color paper, heavy paper, coated paper, bond paper, overhead projector (OHP) sheet, labeling sheet, postcard, tab sheet, and punched sheet. Each paper type is characteristic in grammage (i.e., weight), shape, and surface texture. It is thus necessary for the printing apparatus to perform printing of images appropriate for each paper type.

In general, the printing apparatus performs image printing which is appropriate for such different conditions by switching and controlling an image forming speed and a paper conveyance speed for each paper type. In the case of printing on plain paper, the printing apparatus employs a predetermined speed (hereinafter referred to as a unit speed), and in the case of printing on heavy paper or tab sheets, the printing apparatus employs a speed that is half the speed for printing on plain paper (hereinafter referred to as a ½ speed). Further, in the case of printing on paper of greater grammage (i.e. heavier paper), the printing apparatus switches to a speed that is ⅓ of the speed for printing on plain paper (hereinafter referred to as a ⅓ speed).

A user specifies the above-described settings using a user interface, on which the user registers the paper type for each paper feed stage in the printing apparatus. The printing apparatus thus operates according to the paper type registered by the user. It is necessary for the printing apparatus to perform control accordingly to maintain image quality. However, it is disadvantageous in terms of productivity when the printing apparatus prints at a slow speed so that processing time becomes longer for such paper type.

The user can register the paper type for each paper feed stage assuming that the printing apparatus forms an image on the registered type of paper. However, depending on an operation mode designated by the user, there are cases where no image is formed on the paper. The operation modes include one-sided/two-sided setting, a color mode (i.e., monochrome or color) setting, a reduction layout setting, a front-cover/inserted-sheet/back-cover setting, and a tab sheet setting, which are set for each job. Further, there are settings such as automatic discharge of surplus tab sheets (hereinafter referred to as discharge of remaining tab sheets), and a partition setting, which are set to the printing apparatus instead for each job. If the user specifies such a setting on the printing apparatus, the setting is applied to all jobs.

Japanese Patent Application Laid-Open No. 2006-248672 discusses realizing a function for automatically discharging the remaining tab sheets when a plurality of types of tab sheets is used. Further, Japanese Patent Application Laid-Open No. 2009-222794 discusses discharging the remaining tab sheets when a job is interrupted. Since the remaining tab sheet discharge function is for discharging the surplus tab sheets, any images are not formed on the tab sheets.

In a conventional printing apparatus, sheets are simply conveyed at a speed corresponding to the paper type set in the paper feed stage even in the case where the printing apparatus is not to form an image on the sheets. In such a case, time may be unnecessarily consumed. More specifically, when the printing apparatus performs the remaining tab sheet discharge function, the printing apparatus automatically discharges, after printing a document, a number of sheets as the surplus tab sheets as follows. The printing apparatus automatically discharges a number of sheets corresponding to a difference between a number of tab sheets to be inserted in a printed product and a number of divisions on the tab sheets set in the paper feed stage. The printing apparatus then acquires a set of tab sheets to be used in printing a subsequent document.

The printing apparatus may print an image on the tab sheet to be inserted in the document. Since a thickness of the tab sheet is greater than that of plain paper, it is desirable for the printing apparatus to control the image forming speed and the paper conveyance speed of the tab sheet to be slower, such as at the ½ speed. In the case of performing the remaining tab sheet discharge function, the printing apparatus only discharges the surplus sheets, so that it is not necessary to convey the sheet at the ½ speed, which is time-consuming. However, even in such a case, the printing apparatus performs control to convey the tab sheets at a slower speed as compared to the normal speed.

SUMMARY OF THE INVENTION

According to an aspect of the present invention, a printing apparatus includes a printing unit configured to print an image on a sheet according to image data to generate one copy of printed product, and a conveying unit configured to convey, among one set of a plurality of index sheets, a number of index sheets designated by a user, to add the designated number of sheets to the one copy of printed product generated by the printing unit, wherein the conveying unit conveys, after conveying sheets corresponding to the one copy of printed product, remaining index sheets among the set of a plurality of index sheets to discharge the remaining index sheets, and wherein the conveying unit conveys the index sheets to be added to the one copy of printed product at a first conveyance speed, and conveys the remaining index sheets at a second conveyance speed that is higher than the first conveyance speed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
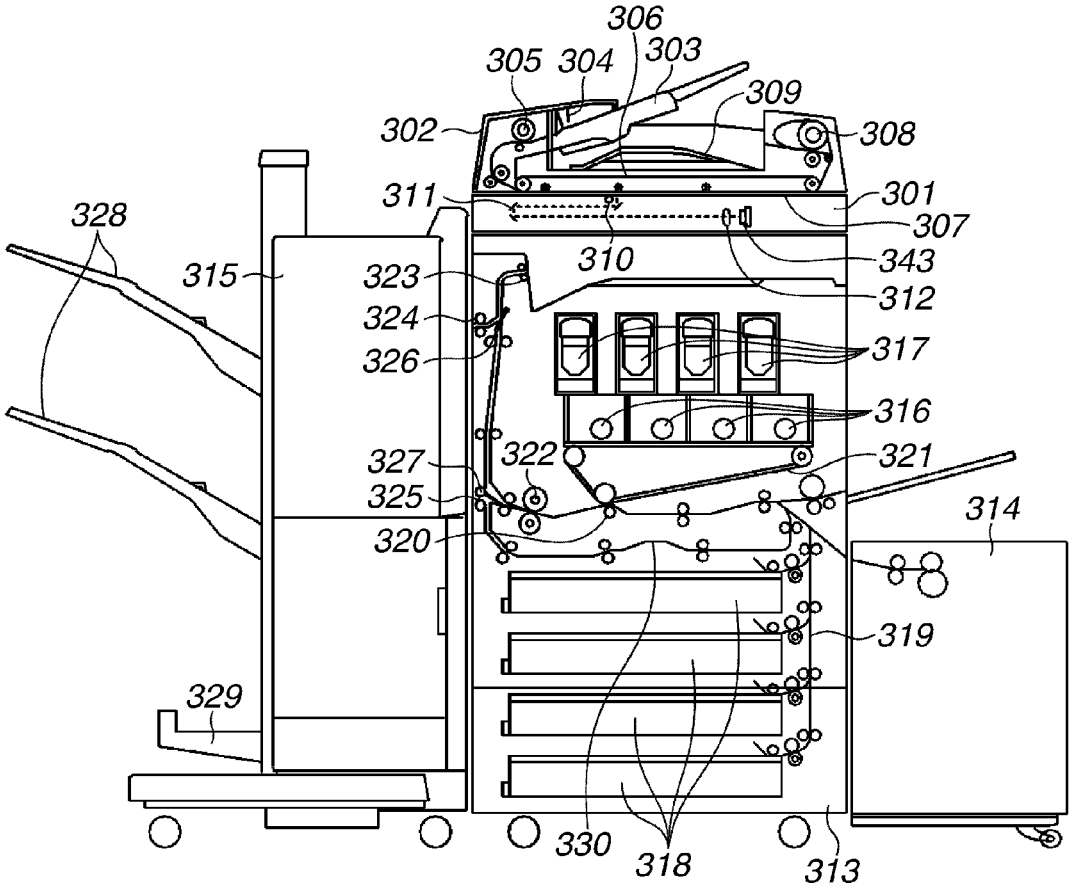
FIG. 1 illustrates a configuration of a printing apparatus according to an exemplary embodiment of the present invention.

FIG. 1 illustrates a configuration of a printing apparatus according to a first exemplary embodiment of the present invention. According to the example illustrated in FIG. 1, a digital multifunction peripheral (i.e., a multifunction peripheral (MFP)) includes a scanner 301, which reads an image, and a printer 313. The MFP performs image processing by the scanner 301 and the printer 313 communicating with each other. However, the present invention is applicable to a printing apparatus which performs a print function. The MFP is capable of performing in parallel a copy function, a printer function, and a facsimile function.

Referring to FIG. 1, the MFP includes the scanner 301, a document feeder (DF) 302, the printer 313, a paper feed deck 314, and a finisher 315. The printer 313, which performs print-recording, includes four-color drums.

A reading operation mainly performed by the scanner 301 will be described below. When the MFP is to read a document placed on a document positioning plate 307, the user places the document on the document positioning plate 307 and closes the DF 302. Upon an open-close sensor detecting that the user has closed the document positioning plate, a reflection type document size detection sensor inside the housing of the scanner 301 detects the size of the placed document. A light source 310 then illuminates the document based on the detected size, and a charge-coupled device (CCD) sensor 343 reads an image via a reflection plate 311 and a lens 312. The CCD sensor 343 thus converts the read image into a digital signal, which is then converted into a laser recording signal after the MFP performs desired image processing. The MFP stores the converted recording signal in a memory in a controller illustrated in FIG. 2 to be described below.

When the MFP is to read a document placed on the DF 302, the user places the document facing up on a tray of a document setting unit 303 in the DF 302. A document presence sensor 304 then detects that the document has been placed, so that a paper feed roller 305 and a conveyance belt 306 rotate and convey the document to a predetermined position on the document positioning plate 307. The MFP reads an image similarly as when reading the document placed on the document positioning plate 307, and stores the converted recording signal in the memory in the controller.

Upon completion of reading the document, the conveyance belt 306 again rotates and conveys the document to aright side with respect to FIG. 1, and discharges the document to a document discharge tray 309 via a conveyance roller 308 in a paper discharge side. If there is a plurality of documents, a subsequent document is fed from a left side with respect to FIG. 1 via the paper feed roller 305 at the same time that the document from the document positioning plate 307 is conveyed to be discharged to the right side. The scanner 301 thus continuously reads the subsequent document.

A print operation performed mainly by the printer 313 for processing a print job including a plurality of pages will be described below.

Figure 2:
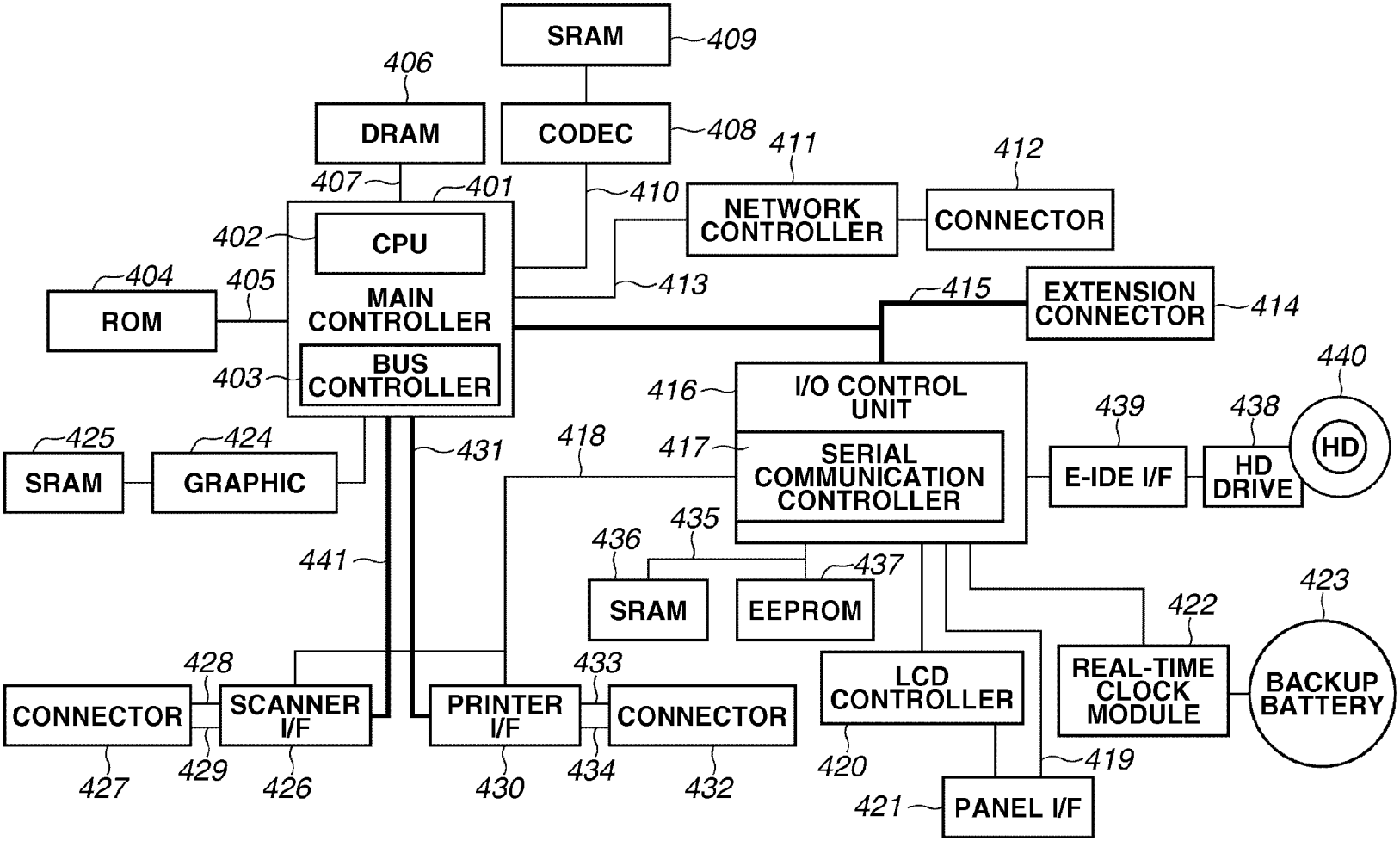
FIG. 2 is a block diagram illustrating a configuration of a controller unit, which controls the printing apparatus.

The recording signal (i.e., image data to be printed) which is temporarily stored in the memory in the controller illustrated in FIG. 2 is transferred to the printer 313. A laser recording unit then converts the recording signal into laser beams for recording in four colors, i.e., yellow, magenta, cyan, and black.

Photosensitive drums 316 corresponding to the respective colors are then irradiated with the respective recording laser beams, so that electrostatic latent images are formed on the photosensitive drums 316. The electrostatic latent images are developed using toner supplied from toner cartridges 317, and images that have become visible are primary-transferred to an intermediate transfer belt 321. The intermediate transfer belt 321 then rotates in a clockwise direction. When a recording sheet fed from a paper cassette 318 or the paper feed deck 314 via a paper feed conveyance path 319 reaches a secondary transfer roller 318, the image is transferred from the intermediate transfer belt 321 to the recording sheet. The paper cassette 318 may feed plain paper, heavy paper, a tab sheet, or an inserted sheet.

A fixing device 322 fixes, by pressure and heat, the toner image transferred to the recording sheet. The recording sheet is then conveyed through a paper discharge conveyance path and is discharged to a face-down center tray 323, is reversed and discharged to a discharge port 324 leading to a finisher 315, or is discharged to a face-up side tray 325. The recording sheet is discharged to the side tray 324 only when the finisher 315 is not attached to the MFP main body. Flappers 326 and 327 switch the conveyance path between the discharge ports.

When the MFP is to perform two-sided printing, the flapper 327 switches the conveyance path after the recording sheet passes through the fixing device 322. The recording sheet is then reversed and transferred to a lower portion, and re-fed to the secondary transfer roller 320 via a two-sided printing paper conveyance path 330, so that the two-sided printing operation is implemented.

The MFP performs circulation control for performing two-sided printing, using the conveyance path including the two-sided printing paper conveyance path 330, the secondary transfer roller 320, and the fixing device 322. The MFP performs 5-sheet circulation control for A4 size paper or letter (LTR) size paper, and 3-sheet circulation control for paper of larger sizes.

The operation performed in the finisher 315 will be described below. The finisher 315 performs post-processing on the printed sheets according to the function designated by the user.

More specifically, the finisher 315 includes a stapling function (i.e., for stapling in one position or two positions), a punching function (i.e., for generating two holes or three holes), and a saddle stitch binding function. The MFP illustrated in FIG. 1 includes two paper discharge trays 328, and the recording sheet which has passed through the discharge port 324 to the finisher 315 is sorted on the paper discharge tray 328 for each of the copy, print, and facsimile functions, according to the user setting.

If the MFP is to be used as a printer, various settings can be specified using a driver, such as monochrome/color printing, paper size, 2-up, 4-up, or N-up printing, two-sided printing, stapling, punching, saddle stitch binding, inserted sheet, front cover, and back cover.

A hardware configuration of the controller, which controls the scanner 301, the printer 313, and network interface units in the printing apparatus, will be described in detail below with reference to FIG. 2.

FIG. 2 is a block diagram illustrating a configuration of the controller unit, which controls the printing apparatus illustrated in FIG. 1. Referring to FIG. 2, a main controller 401 mainly includes a central processing unit (CPU) 402, a bus controller 403, and various interface (I/F) controller circuits.

The CPU 402 and the bus controller 403 control the operations of the entire printing apparatus. The CPU 402 operates based on programs read from a read-only memory (ROM) 404 via an ROM I/F 405. Further, such programs describe an operation for interpreting page description language (PDL) code data received from a data processing apparatus (i.e., a personal computer (PC), not illustrated), and rasterizing the code data into raster image data. The operation is thus performed using software.

The bus controller 403 controls transferring of the data input to and output from each I/F, and controls arbitration of the bus and direct memory access (DMA) data transfer.

A dynamic random access memory (DRAM) 406 is connected to the main controller 401 via a DRAM I/F 407. The DRAM 406 is used as a work area for the CPU 402 to operate, and as an area for storing the image data.

A codec 408 compresses the raster image data stored in the DRAM 406 using compression methods such as modified Hoffman (MH), modified relative element address designate (READ) (MR), modified MR (MMR), Joint Bi-level Image Experts Group (JBIG), and Joint Photographic Experts Group (JPEG). Further, the codec 408 decompresses the compressed and stored code data into raster image data.

A static RAM (SRAM) 409 is used as a temporary work area for the codec 408. The codec 408 is connected to the main controller 401 via the I/F 410. The bus controller 403 controls transferring of data between the DRAM 406, so that the data is DMA-transferred.

A graphic processor (i.e., Graphic) 424 performs, with respect to the raster image data stored in the DRAM 406, each of image rotation, image zooming, color space conversion, and binarization processes. An SRAM. 425 is used as a temporary work area for the graphic processor 424. The SRAM 425 is connected to the main controller 401 via the I/F 410, and the bus controller 403 controls transferring of data between the DRAM 406, so that the data is DMA-transferred.

A network controller 411 is connected to the main controller 401 via an I/F 413, and to an external network via a connector 412. In general, the network is a local area network.

A general-purpose high speed bus 415 is connected to an extension connector 414, which is used for connecting an extension board, and an input/output (I/O) control unit 416. A common example of the general-purpose high speed bus 415 is a peripheral component interconnect (PCI) bus. The I/O control unit 416 includes two channels of asynchronous serial communication unit controller 417 for transmitting and receiving a control command between each of the CPU in the scanner 301 and the printer 313. An I/O bus 418 is connected to a scanner I/F circuit 426 and a printer I/F circuit 430.

A panel I/F 421 is connect to a liquid crystal display (LCD) controller 420. The panel I/F 421 includes an I/F for displaying on an LC screen in the operation unit, and a key input I/F for the user to input using hard keys and touch panel keys.

An operation unit 501 (illustrated in FIG. 3) includes an LC display unit, a touch panel device attached to the LC display unit, and a plurality of hard keys. The signal input from the touch panel or using the hard keys is transmitted to the CPU 402 via the panel I/F 421, and the LC display unit displays the image data transmitted from the panel I/F 421. The LC display unit displays the functions and the image data when the user operates the printing apparatus.

A real-time clock module 422 updates and stores dates and time managed in the apparatus, and is backed up by a backup battery 423.

An enhanced integrated drive electronics (E-IDE) I/F 439 connects to an external storage device. According to the present exemplary embodiment, a hard disk (HD) drive 438 is connected to the printing apparatus via the E-IDE I/F 439, for storing the image data in a hard disk 440, or reading the image data from the hard disk 440. Connectors 427 and 432 are respectively connected to the scanner 301 and the printer 313. The connectors 427 and 432 include synchronous serial I/Fs 428 and 433 and video I/Fs 429 and 434.

A scanner I/F 426 is connected to the scanner 301 via the connector 427. Further, the scanner I/F 426 is connected to the main controller 401 via a scanner bus 441, and includes a function for performing a predetermined process with respect to the image received from the scanner 301. Furthermore, the scanner I/F 426 includes a function for outputting to the scanner bus 441 a control signal generated based on a video control signal transmitted from the scanner 301. The bus controller 403 controls transferring of data from the scanner bus 441 to the DRAM 406.

A printer I/F 430 is connected to the printer 313 via the connector 432, and to the main controller 401 via the printer bus 431. According to the present exemplary embodiment, the main controller 401 performs a predetermined process on the image data and outputs the processed image data to the printer 313. Further, the main controller 401 includes the function for outputting to the printer bus 431 the control signal generated based on a video control signal transmitted from the printer 313.

The bus controller 403 controls transferring of the raster image data rasterized in the DRAM 406 to the printer 313. The raster image data is DMA-transferred to the printer 313 via the printer bus 431 and the video I/F 434.

A SRAM 436 is a memory capable of maintaining stored content using a power source supplied from the backup battery, even when the power of the entire printing apparatus is shut down. The SRAM 436 is connected to the I/O control unit 416 via the bus 435. An electrically erasable programmable ROM (EEPROM) 437 is a memory similarly connected to the I/O control unit 416 via the bus 435.

Figure 3:
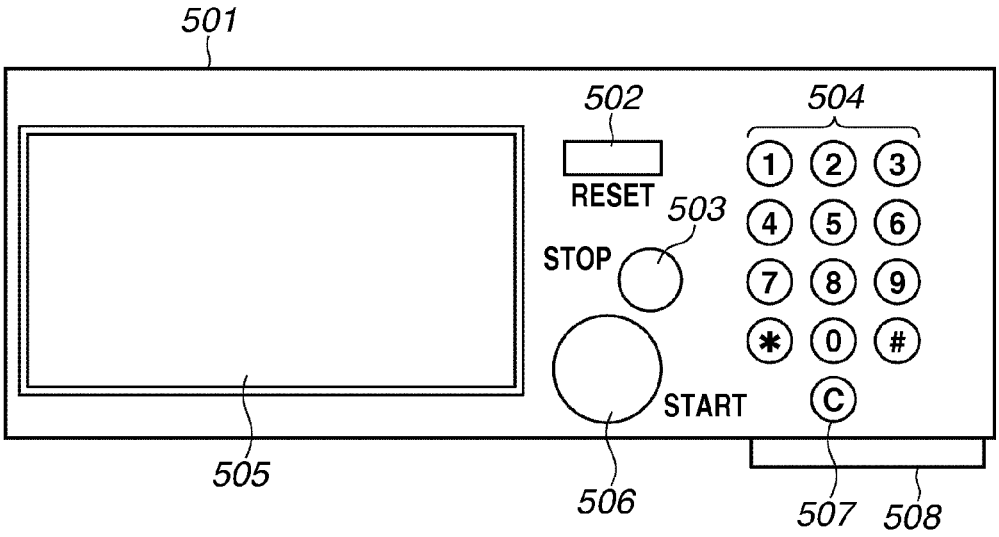
FIG. 3 is a plan view illustrating a configuration of an operation unit in the printing apparatus illustrated in FIG. 1.

The operation unit used by the user to specify various print settings will be described below. FIG. 3 is a plan view illustrating the configuration of the operation unit in the printing apparatus illustrated in FIG. 1.

Referring to FIG. 3, an operation unit 501 is connected to the panel I/F 421 illustrated in FIG. 2. A reset key 502 can be pressed by the user when cancelling a setting value set by the user.

A stop key 503 can be pressed by the user when cancelling a job in operation. A ten key 504 can be pressed by the user when inputting numerical values such as a register number. A touch panel operation screen (i.e., a touch panel) 505 displays the screen illustrated in FIG. 4. There are a number of touch panel buttons displayed on the screens to be described below for specifying various settings.

A start key 506 can be pressed by the user when starting a job such as reading a document. A clear key 507 can be pressed by the user when clearing the setting value set by the user.

Figure 4:
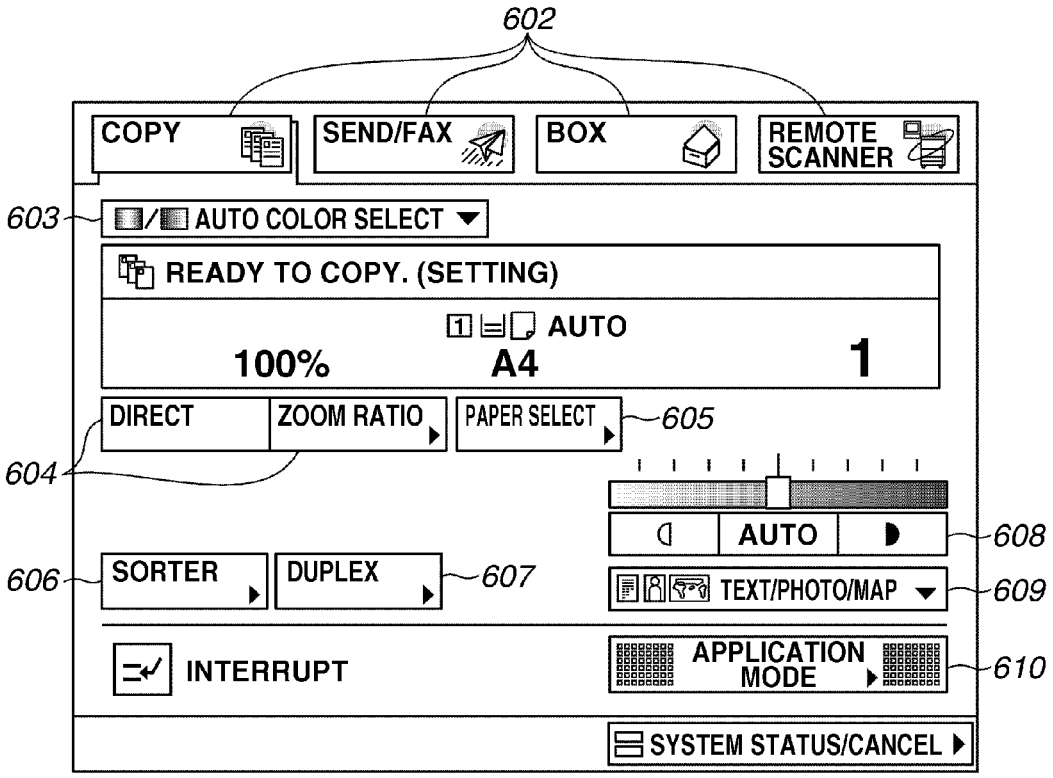
FIG. 4 illustrates a user interface (UI) screen displayed on a touch panel.

Contents displayed on the touch panel 505 illustrated in FIG. 3 will be described below with reference to FIG. 4. FIG. 4 illustrates a UI screen displayed on the touch panel 505. The present example illustrates a state in which a standard screen of the copy function is currently displayed on the touch panel 505.

Referring to FIG. 4, tabs 602 can be pressed by the user when selecting the functions corresponding thereto. The tabs 602 corresponding to the copy function and for selecting a transmission function, i.e., facsimile transmission, e-mail transmission, and transmission to a file server, are disposed in an order from the left. Further, the tab 602 disposed on the right side of the tab for selecting the transmission function corresponds to a box function. The box function allows storing in the hard disk in the printing apparatus the image data read by the scanner 301, and operating on or printing the stored data. Furthermore, the tab 602 disposed on the right side of the box function tab corresponds to a remote scanner function for operating the PC via the network and inputting a scanned image in the PC. According to the present exemplary embodiment, when the user selects a tab corresponding to each function, the screen jumps to the screen in which the user can specify detailed settings to each function. The example illustrated in FIG. 4 is the copy function screen.

A button 603 is used for selecting a color mode. When the user presses the button 603, a pull-down menu is displayed, and the user can select a mode from among a "color" mode, a "monochrome" mode, and an "automatic" mode. The example of FIG. 4 illustrates the state where the user has selected the "automatic" mode. Further, a zoom designation button 604, a paper select button 605, a sorter button 606 for designating finishing, e.g., shift-sort and staple-sort, and a duplex button 607 for designating two-sided printing are disposed in the UI screen. Furthermore, a bar 608 for designating density, a button 609 for selecting a document type, and an application mode button 610 for setting other types of application modes are arranged in the UI screen.

Figure 5A:
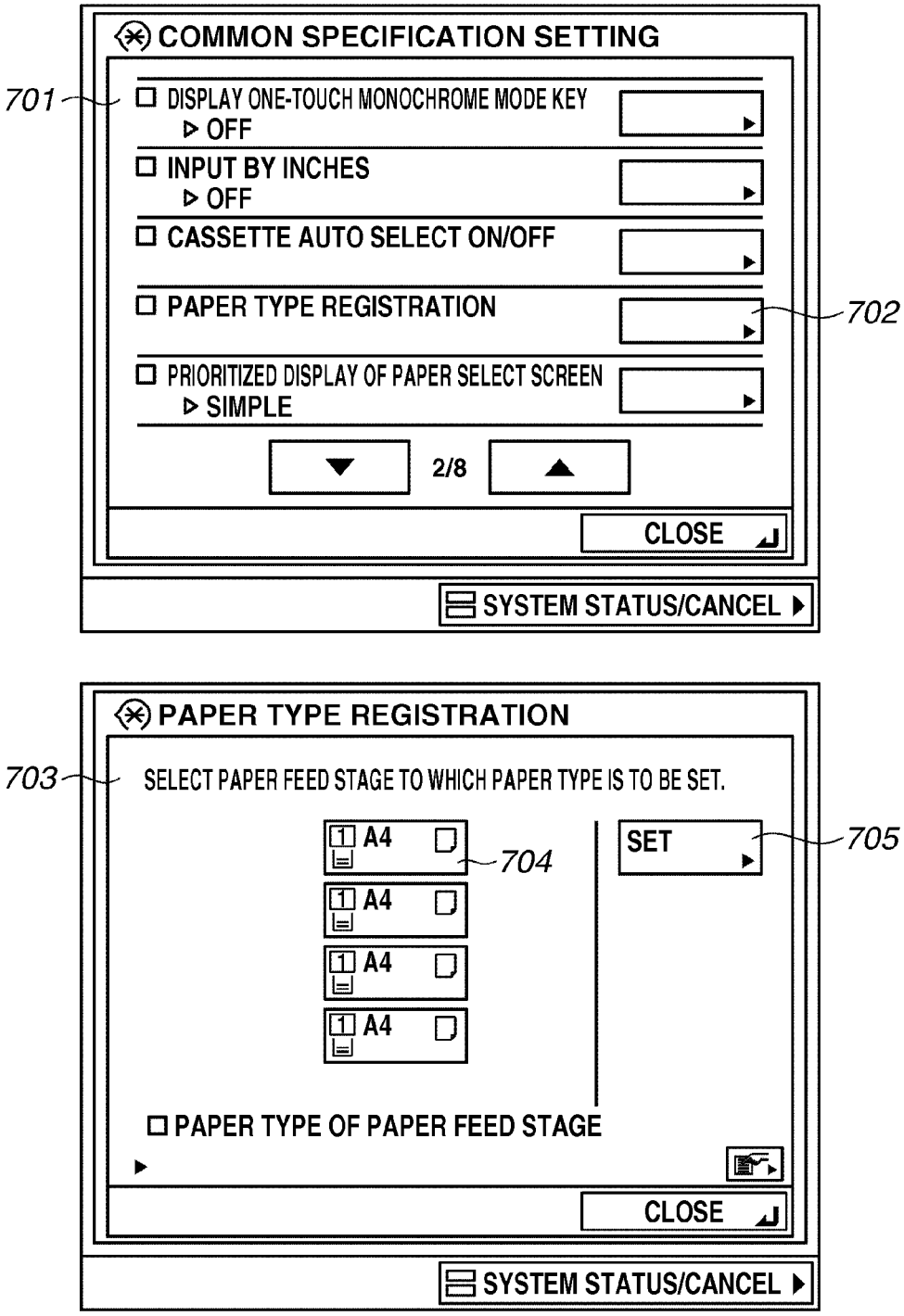
FIGS. 5A, 5B, and 5C illustrate UI screens displayed on the touch panel.
Figure 5B:
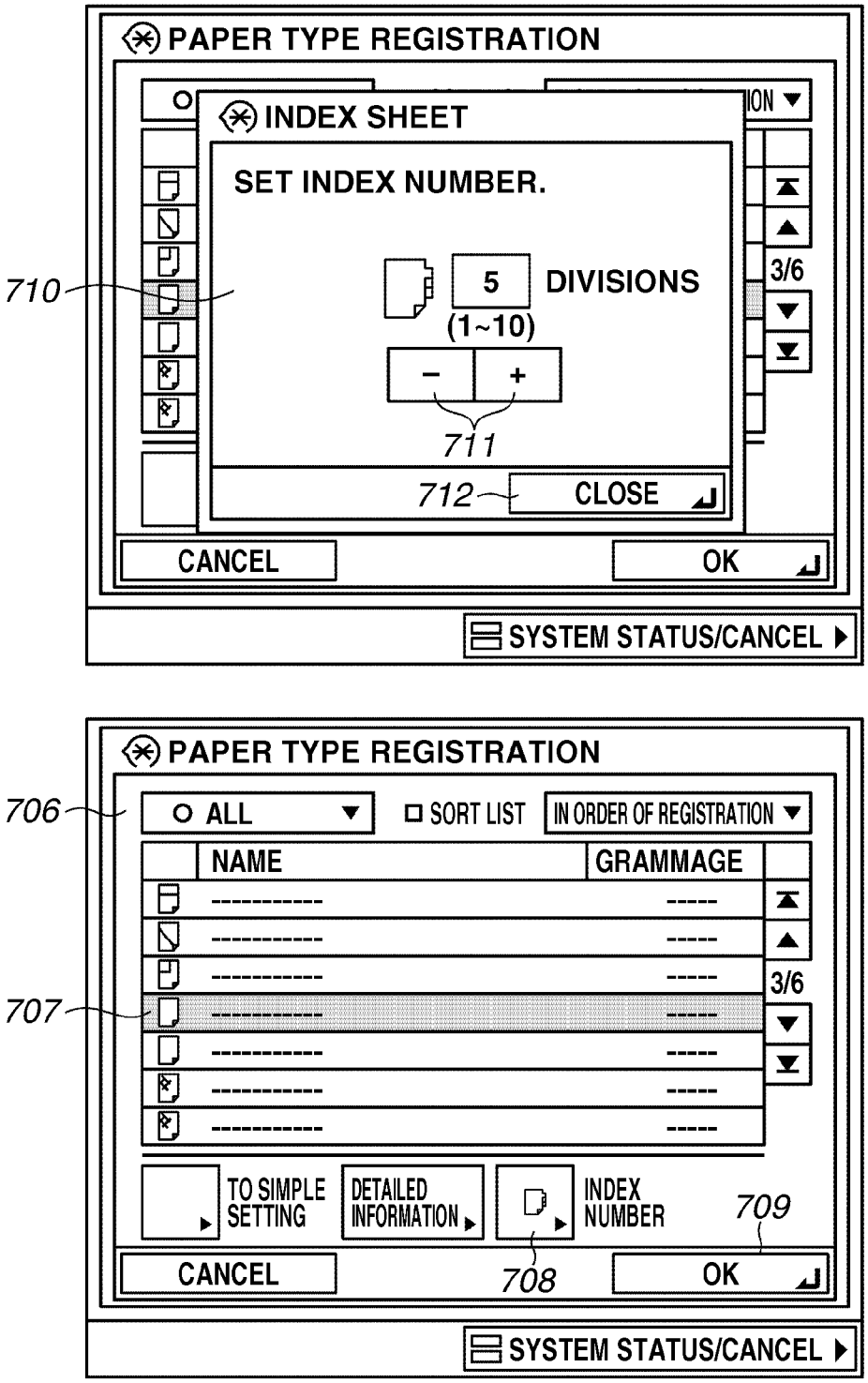
Figure 5C:
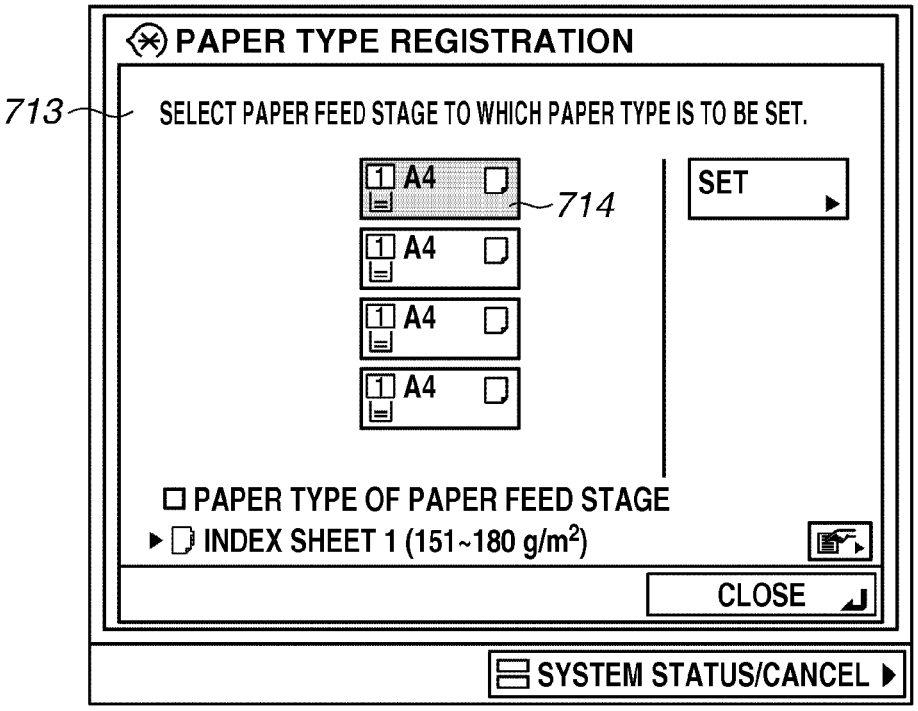

FIGS. 5A, 5B, and 5C illustrate detailed examples of the UI screens, which are displayed on the touch panel 505 illustrated in FIG. 3. The examples illustrated in FIGS. 5A, 5B, and 5C are specific setting screens of a paper type setting unit. An example in which the UI screen illustrated in FIG. 5C is used to set a print condition according to the grammage of the paper to be fed by each paper feed cassette will also be described below.

Referring to FIG. 5A, a common specification setting screen 701 is used for specifying common settings to the printing apparatus. If the user presses a button 702 for registering the paper type, the display screen jumps to a display screen 703. The display screen 703 displays a screen 704 for selecting a paper feed section, according to the configuration of the paper feed unit in the printing apparatus.

FIG. 5A illustrates an example in which the display screen 703 is displaying a setting screen for a paper feed unit including four cassettes. Further, the display screen 703 displays information on the paper type which has been previously set, in the form of an icon and a message. If the user selects one of the paper feed stages using the touch panel 505, a setting button 705 becomes able to be pressed by the user. If the user then presses the setting button 705, the display screen jumps to a display screen 706 illustrated in FIG. 5B.

Referring to FIG. 5B, the display screen 706 displays a list of the names and the grammage of the paper types that can be selected, so that the user can select one of the paper types. The display screen 706 indicates a state in which the user has selected a tab sheet 707. If the user selects the tab sheet 707 as the paper type, a button 708 for selecting an index number of the tab sheets is displayed. It is assumed that at least one of the paper feed cassettes is capable of feeding the tab sheets of which one set includes a plurality of pages of different tab positions.

In the case where the printing apparatus is to perform the remaining tab sheet discharge function, the index number (i.e., a tab number) of the tab sheets is information to be used in calculating the number of remaining tab sheets. The remaining tab sheet discharge function discharges to outside the printing apparatus, the tab sheets which are not to be inserted in a body text, and correctly inserts the tab sheets from the top tab sheet with respect to the subsequent copy of the printed product.

Upon the user pressing the button 708 for selecting an index number of the tab sheets on the display screen 706, the display screen jumps to a display screen 710. In the display screen 710 illustrated in FIG. 5B, a default value of the index number is preset to "5". However, the user can operate on + and − keys 711 including two keys, and change the index number within a range of 1 to 10. If three tab sheets are to be inserted in the body text when the user has set the index number to "5", the remaining tab sheet discharge function calculates the number of tab sheets to be automatically discharged as 5−3=2, i.e., two sheets.

If the user presses a close button 712, the display screen returns to the display screen 706, and if the user then presses an OK key 709 in the display screen 706, the screen for setting the paper type ends. The display screen thus jumps to a display screen 713 illustrated in FIG. 5C. Referring to FIG. 5C, an icon 714 indicating a tab sheet is displayed in a cassette 1 to which the user has specified the setting. Further, a message on the paper type, i.e., "index sheet 1 (151 to 180 g/m$^2$)" is displayed in a lower left portion in the screen. The paper type setting unit is configured as described above.

Figure 6A:
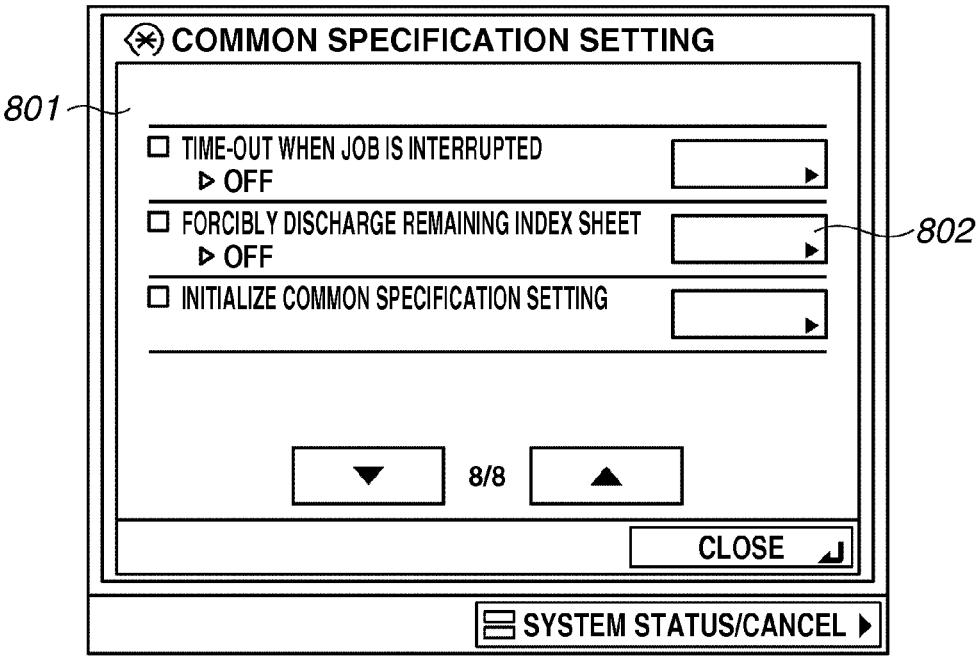
FIGS. 6A and 6B illustrate UI screens displayed on the touch panel.
Figure 6B:
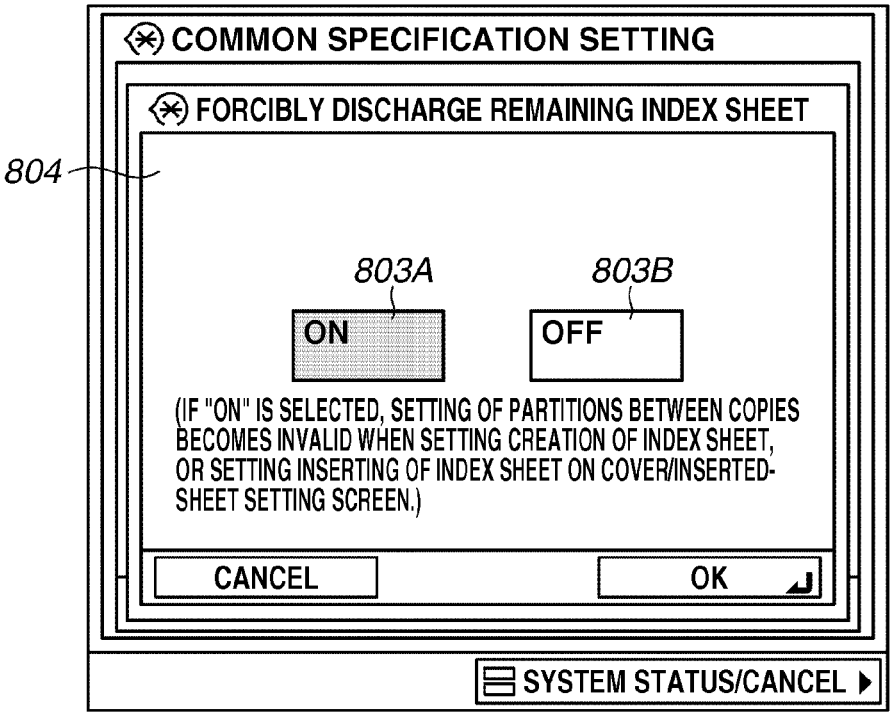

FIGS. 6A and 6B illustrate the UI screens displayed on the touch panel 505. The examples in FIGS. 6A and 6B illustrate specific setting screens of an operation mode setting unit.

Referring to FIG. 6A, a common specification screen 801 is used by the user to specify the common settings to the printing apparatus, similar to the screen illustrated in FIG. 5A. If the user presses in the common specification screen 801 an ON/OFF setting button 802 for setting or not setting forcibly discharging the remaining index sheets, the display screen jumps to a screen 804 illustrated in FIG. 6B. The user can select on the setting screen 804 whether to set on or off forcibly discharging the remaining index sheets.

If the user presses an "ON" button 803A in the screen 804, the printing apparatus feeds, when the printing apparatus is to execute a job using the tab sheets (i.e., the index sheets), the tab sheets from the cassette 1 as described in the specific examples illustrated in FIGS. 5A, 5B, and 5C. According to the present exemplary embodiment, when the printing apparatus is to discharge the remaining tab sheets, the printing apparatus does not operate according to the paper type specified to the cassette 1 as illustrated in FIG. 5C. The printing apparatus operates instead by switching to perform control according to the condition for conveying plain paper.

Figure 7:
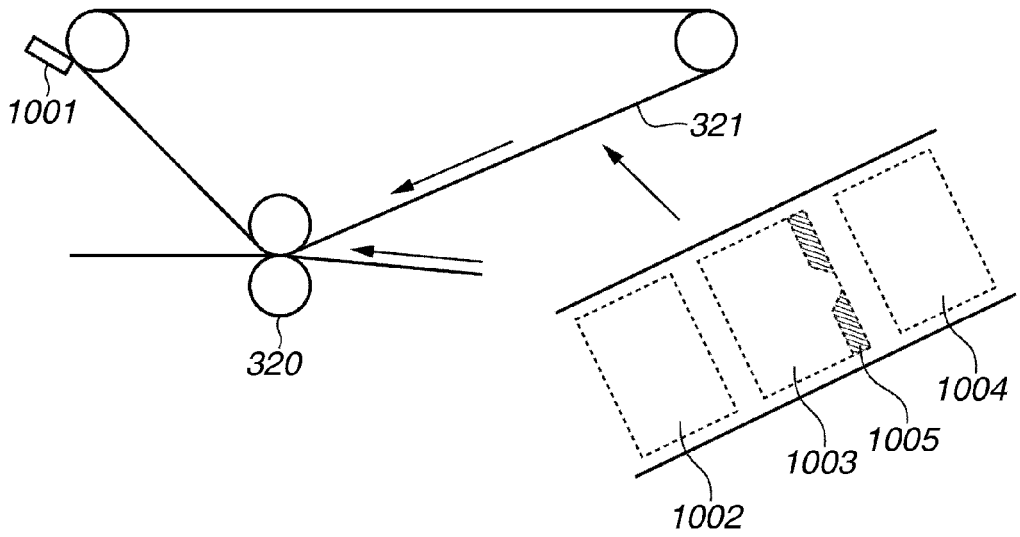
FIG. 7 illustrates an image forming process performed by the printing apparatus according to an exemplary embodiment of the present invention.

FIG. 7 illustrates the image forming process performed by the printing apparatus according to the present exemplary embodiment. According to the present exemplary embodiment, a cleaning operation, which is performed when the printing apparatus forms an image on the tab sheets, will be described in detail below. Further, the cleaning operation becoming unnecessary when the printing apparatus does not form an image will also be described below. Furthermore, timing charts illustrated in FIGS. 8A, 8B, and 8C will be described below.

FIG. 7 mainly illustrates the intermediate transfer belt 321 and the secondary transfer roller 320 illustrated in FIG. 1. Referring to FIG. 7, an image which has been primary-transferred from the developing unit to a horizontal portion of the intermediate transfer belt 321 is conveyed on the intermediate transfer belt 321. The image is conveyed clockwise in a direction indicated by an arrow pointed to the lower left illustrated in FIG. 7. According to the present example, images corresponding to plain paper 1002, a tab sheet 1003, and plain paper 1004 are formed on the intermediate transfer belt 321.

The image corresponding to the plain paper 1002, which is indicated by a dotted rectangle, is formed on the intermediate transfer belt 321. The image corresponding to the plain paper 1002 is secondary-transferred at the secondary transfer roller 320 to a sheet conveyed according to an arrow from the lower right side illustrated in FIG. 7. When the image is transferred to the sheet, the sheet is conveyed to the fixing unit disposed downstream with respect to the printing apparatus. Further, since the image corresponding to the plain paper 1002 formed on the intermediate transfer belt 321 matches the sheet to which the image is to be secondary-transferred, the secondary transfer roller 320 is not soiled.

If the printing apparatus is to form an image corresponding to the tab sheet 1003, it becomes necessary to form the image on a tab portion of the tab sheet. Since the position of the tab in the tab sheet is variable, and it is difficult to cut out the image according to a shape of the tab, the image corresponding to the tab sheet 1003 including a portion 1005 in which the tab does not exist is formed on the intermediate transfer belt 321.

As a result, if there is an image formed in the portion 1005 in which the tab does not exist, the toner may be transferred to the secondary transfer roller 320 when the printing apparatus performs secondary transfer. If the printing apparatus then continues to form the image on the subsequent page of the plain paper 1004 and onwards in such a state, the toner attached to the roller 320 is transferred to a back side of the plain paper. Image deterioration is thus generated as back side soiling.

To solve such a problem, when the printing apparatus is to form an image on the tab sheet, the printing apparatus applies to the secondary transfer roller 320 positive and reverse biases after the image corresponding to the tab sheet 1003 passes through the position of the secondary transfer roller 320. The printing apparatus applies the positive and reverse biases to the secondary transfer roller 320 a plurality of times. The printing apparatus thus re-transfers to the intermediate transfer belt 321 the toner attached to the secondary transfer roller 320. The toner is then conveyed to a cleaning blade 1001, so that the toner re-transferred to the intermediate transfer belt 321 is cleaned by the cleaning blade 1001.

To perform the above-described process, it becomes necessary for the printing apparatus to rotate the secondary transfer roller 320 for a period of time. The printing apparatus is thus required to delay forming an image on the subsequent page of the plain paper 1004 and create a sheet-to-sheet interval. As a result, a cleaning time 204 illustrated in FIG. 8A becomes necessary for performing the cleaning operation.

Figure 8A:
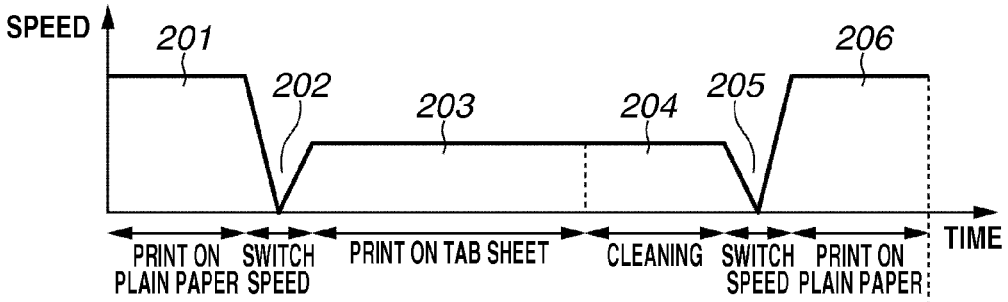
FIGS. 8A, 8B, and 8C are timing charts illustrating operation timings of the printing apparatus.
Figure 8B:
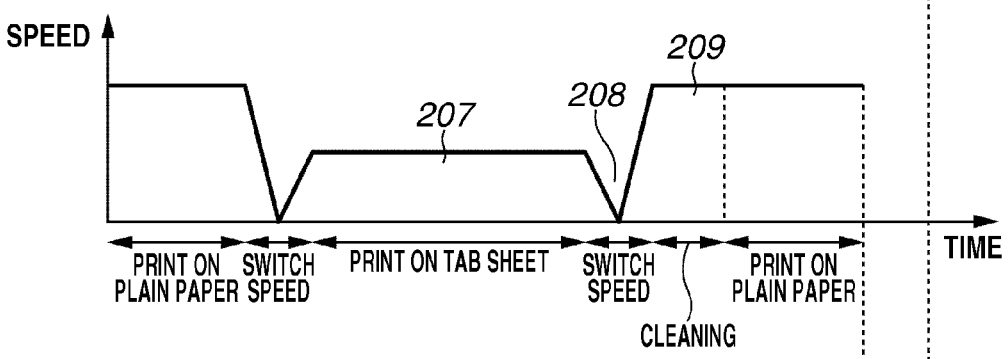
Figure 8C:
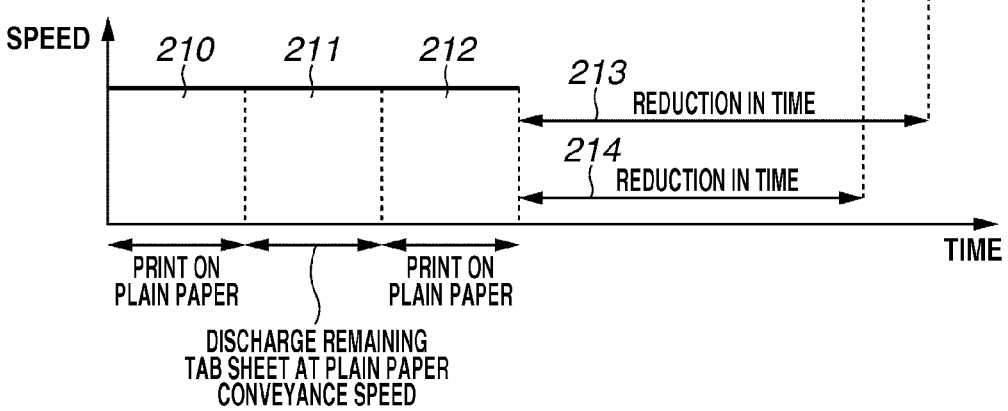

FIGS. 8A, 8B, and 8C are timing charts illustrating operation timings of the printing apparatus illustrated in FIG. 1. Referring to FIG. 8A, the time in which the printing apparatus forms an image on the plain paper 1002 illustrated in FIG. 7 corresponds to a time 201 illustrated in FIG. 8A. Since it becomes necessary for the printing apparatus to switch the speed when forming an image on the tab sheet 1003, a speed switching time 202 illustrated in FIG. 8A is required. After the printing apparatus switches the speed, the time in which the printing apparatus forms an image on the tab sheet 1003 corresponds to a time 203. The speed then becomes the ½ speed, so that twice the length of time becomes necessary for the printing apparatus to form an image on the tab sheet as compared to forming an image on plain paper.

The printing apparatus performs the cleaning operation during the cleaning time 204. In other words, the printing apparatus applies the positive and reverse biases to the secondary transfer roller 320 during the cleaning time 204 to prevent back side soling of the image in the portion 1005 in which the tab does not exist. The printing apparatus then switches the speed at a switching time 205 to return the speed to the unit speed for forming an image on the plain paper 1004. The printing apparatus forms an image on the plain paper 1004 in a time 206.

FIG. 8B illustrates another example of the speed switching operation. The example illustrated in FIG. 8B is different from the example illustrated in FIG. 8A in that the printing apparatus performs the cleaning operation (during a time 209) subsequent to forming an image on the tab sheet 1003 (during a time 207), after switching the speed. In other words, the printing apparatus performs the cleaning operation at the unit speed after returning the speed to the unit speed in a switching time 208, so that the time can be reduced as compared to the example illustrated in FIG. 8A.

The above-described cleaning operation is control performed uniquely with respect to tab sheets in which an image may be formed outside an area of the sheet. However, among cases where the tab sheets are fed, it becomes unnecessary for the printing apparatus to perform the cleaning operation when the printing apparatus only conveys the sheets without forming an image, such as discharging the remaining tab sheets.

Further, in such a case, it becomes unnecessary for the printing apparatus to reduce the speed to the ½ speed. According to the present exemplary embodiment, the printing apparatus thus does not switch the speed at remaining tab sheet discharge timing 211 illustrated in FIG. 8C after printing on the plain paper in a printing time 210. The printing apparatus also omits the cleaning operation. As a result, when the printing apparatus discharges the remaining tab sheets, there are reductions in time 213 and 214 as compared to the conventional case where the printing apparatus reduces the speed and performs the cleaning operation.

Figure 9A:
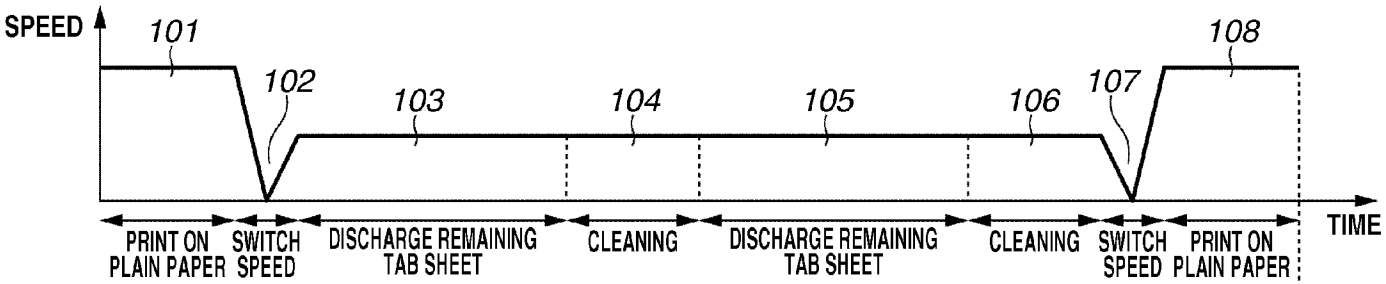
FIGS. 9A and 9B illustrate printing sequences in the printing apparatus.
Figure 9B:
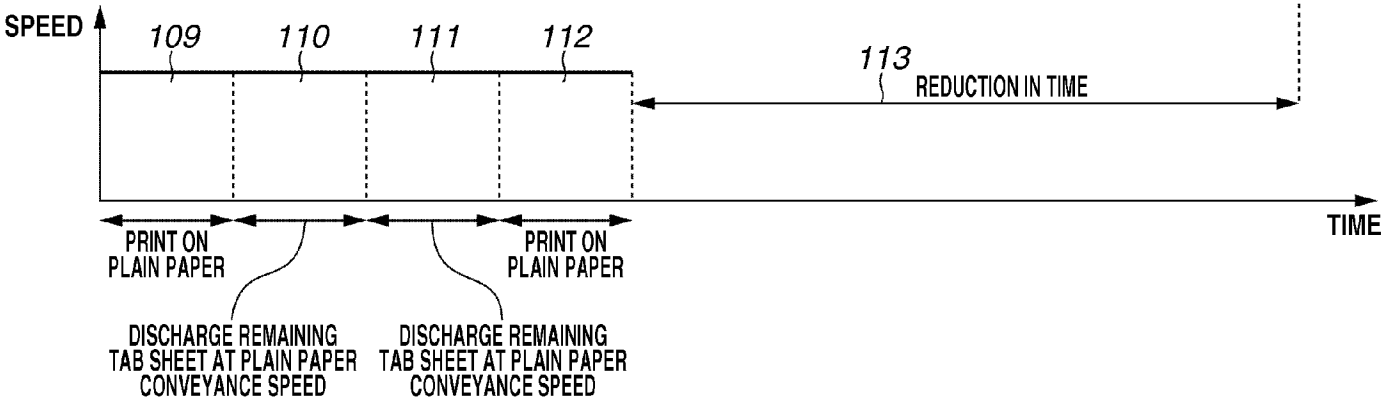

FIGS. 9A and 9B are timing charts illustrating the print sequences in the printing apparatus according to the present exemplary embodiment. The present examples illustrate a specific time reduction effect in the case where the print sequence according to the present exemplary embodiment is applied.

Referring to FIGS. 9A and 9B, the paper conveyance speed is indicated on the vertical axis, and the time is indicated on the horizontal axis. Referring to FIG. 9A, print timing 101 for printing on plain paper is followed by tab sheet processing timings 103 and 105 for discharging the remaining tab sheets for two tab sheets, and plain paper processing timing 108 for processing the subsequent plain paper (i.e., a top page of the subsequent copy or the top page of the subsequent job). According to the present exemplary embodiment, the paper conveyance speed of a tab sheet is half the paper conveyance speed of plain paper (i.e., a unit speed). A height indicated on the vertical axis, i.e., the speed of the tab sheet, thus becomes half that of the plain paper. Further, the time necessary for conveying the tab sheet becomes twice that of the plain paper, so that the length on the horizontal axis indicating the time for conveying the tab sheet becomes twice that for conveying the plain paper.

FIG. 9A corresponds to conventional sequence control. Referring to FIG. 9A, after the printing apparatus prints on the plain paper at the print timing 101, the printing apparatus switches the speed at timing 102 for printing on the subsequent sheet, i.e., the tab sheet. The printing apparatus then conveys the tab sheet at the tab sheet processing timing 103. According to the conventional control method, the printing apparatus performs control according to the paper type set in the paper feed stage even when the remaining tab sheet is to be discharged, so that the conveyance speed is controlled at the ½ speed. Further, if the printing apparatus is to feed the tab sheet, it becomes necessary to perform the cleaning operation as described above.

The printing apparatus performs the cleaning operation at timing 104. The printing apparatus then conveys a second tab sheet at the tab sheet processing timing 105, and performs cleaning at timing 106. The printing apparatus switches the speed at timing 107 for conveying the plain paper, and conveys the plain paper at the plain paper processing timing 108.

In contrast, according to the present exemplary embodiment, timing 109 illustrated in FIG. 9B corresponds to the print timing 101 illustrated in FIG. 9A, in which the printing apparatus performs similar control.

At timing 110, it is determined according to the operation mode that the printing apparatus is to discharge the remaining tab sheet without forming an image on the tab sheet. As a result, the printing apparatus does not perform control which is performed at the timing 102 illustrated in FIG. 9A, and conveys the tab sheet at the speed for conveying the plain paper. The time necessary for discharging the remaining tab sheet at the timing 110 thus becomes the same as when conveying the plain paper.

Further, since the printing apparatus does not form an image on the tab sheet, it becomes unnecessary to perform the cleaning operation as in the timing 104 illustrated in FIG. 9A. The printing apparatus can thus immediately convey the second tab sheet to be discharged at timing 111. Furthermore, it becomes unnecessary for the printing apparatus to switch the paper conveyance speed for printing on the plain paper, so that the printing apparatus can continue to form an image at timing 112.

According to the present exemplary embodiment, there is no time loss due to switching of the paper conveyance speed as in the timings 102 and 107 illustrated in FIG. 9A, and due to conveyance of the sheet at the ½ speed as in the tab sheet processing timings 103 and 105 illustrated in FIG. 9A. Further, the cleaning operation unique to tab sheets performed at the timings 104 and 106 illustrated in FIG. 9A can be skipped. As a result, time reduction indicated as timing 113 illustrated in FIG. 9B can be realized, and the total time necessary for performing the print sequence can be greatly reduced.

Figure 10:
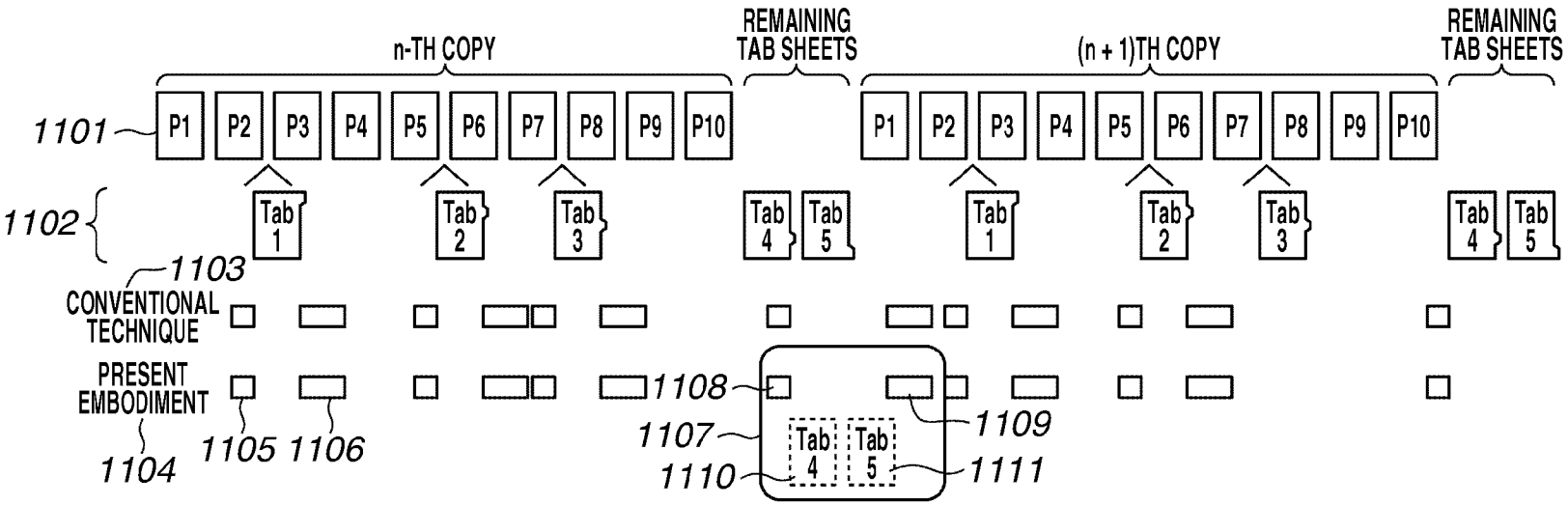
FIG. 10 illustrates a printing sequence in the printing apparatus.
Figure 11:
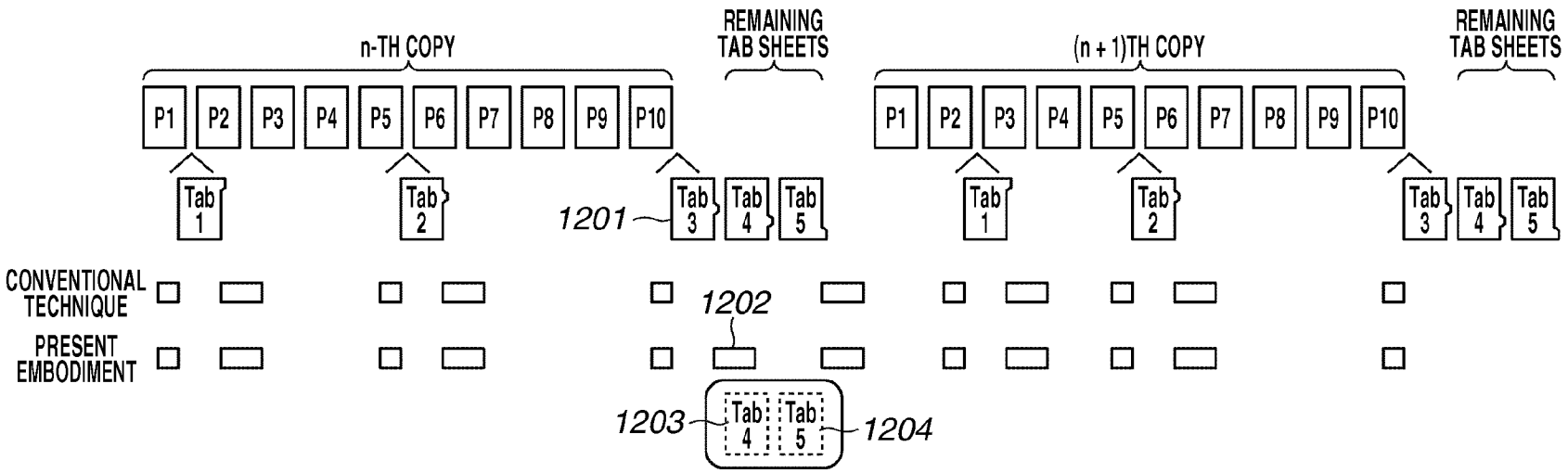
FIG. 11 illustrates a printing sequence in the printing apparatus.
Figure 12:
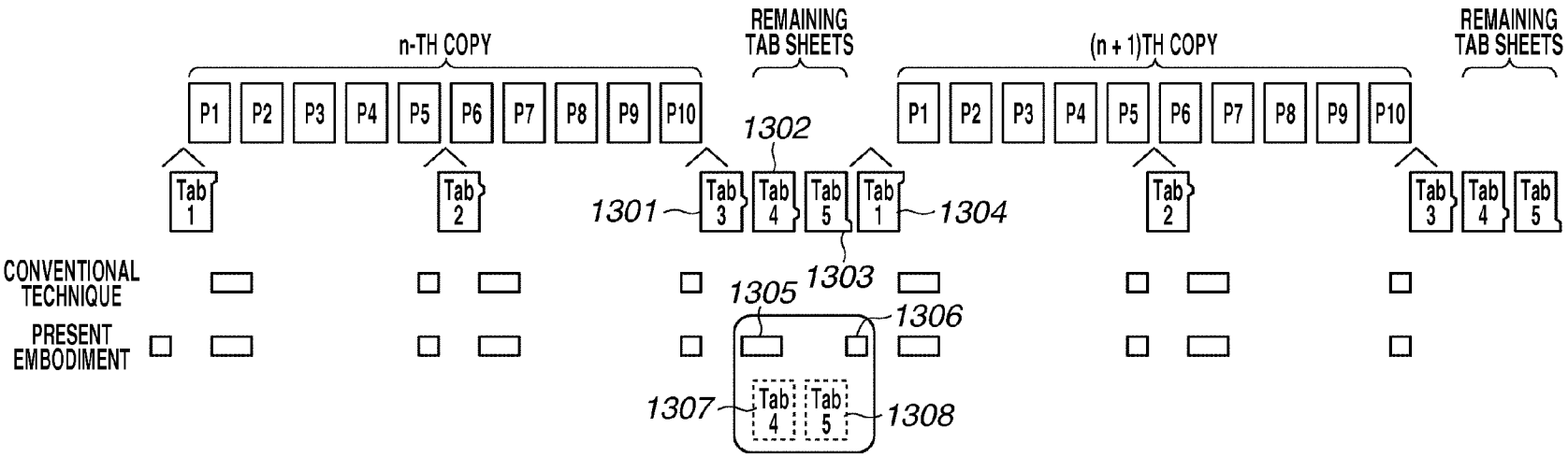
FIG. 12 illustrates a printing sequence in the printing apparatus.

The print sequences performed in the case where the printing apparatus prints a plurality of copies will be described below with reference to FIGS. 10, 11, and 12. FIGS. 10, 11, and 12 illustrate the print sequences performed in the printing apparatus according to the present exemplary embodiment. The timings for switching the speed and performing cleaning when the printing apparatus discharges the remaining tab sheets will be described below.

First Print Sequence Example

In the first print sequence example illustrated in FIG. 10, a row 1101 focuses on the n-th copy and the (n+1)th copy in the case where the printing apparatus is to print a plurality of copies of a document including 10 pages, i.e., pages 1 to 10. A row 1102 illustrates the tab sheets. More specifically, the row 1102 indicates an example in which a mode for inserting, in the body text, three tab sheets among a set of tab sheets including five tabs, is set as the job.

In the rows 1101 and 1102, a first tab sheet Tab 1 is inserted previous to a body text page P3, a second tab sheet Tab 2 previous to a body text page P6, and a third tab sheet Tab 3 previous to a body text page P8. According to the present exemplary embodiment, since one set of tab sheets includes 5 tabs, the printing apparatus operates to automatically discharge 5−3=2, i.e., two tab sheets (i.e., the fourth and fifth tab sheets) between printing the n-th copy and the (n+1)th copy.

A row 1103 schematically illustrates speed switching and cleaning operations when the printing apparatus performs control according to a conventional technique. Since the printing apparatus forms images on the tab sheets with respect to the tab sheets Tab 1, Tab 2, Tab 3, Tab 4, and Tab 5, it becomes necessary for the printing apparatus to perform a speed switching operation 1105 previous to printing on each of the tab sheets. Further, it becomes necessary for the printing apparatus to perform a cleaning and speed switching operation 1106 after printing on each of the tab sheets.

A row 1104 illustrates the case where the printing apparatus performs control according to the present exemplary embodiment.

According to the present exemplary embodiment, it is necessary for the printing apparatus to perform the speed switching and cleaning operation before and after processing the tab sheets (i.e., Tab 1, Tab 2, and Tab 3), similarly as in the conventional technique. However, it is unnecessary to for the printing apparatus to perform a process of a portion 1107 corresponding to the tab sheets Tab 4 and Tab 5.

More specifically, it becomes unnecessary for the printing apparatus to perform, before and after discharging the remaining tab sheets (i.e., Tab 4 and Tab 5), a speed switching operation 1108 and a cleaning and speed switching operation 1109. Further, the printing apparatus can convey the two tab sheets indicated by processes 1110 and 1111 at the unit speed.

If a tab sheet insertion position is not designated at the beginning and the end of the body text, the printing apparatus ignores the setting specified on the paper type setting unit with respect to the remaining sheets to be discharged. The printing apparatus thus performs control to operate as in the case of processing the plain paper.

Second Print Sequence Example

The second print sequence example will be described below with reference to FIG. 11.

The second print sequence is similar to the first print sequence illustrated in FIG. 10. However, the second print sequence is different in that the job setting is specified as described below. The printing apparatus is to insert a tab sheet 1201 subsequent to the body text page P10, which is a final page of the body text, among the tab sheet insertion positions with respect to the body text.

In such a case, the printing apparatus continuously discharges the tab sheets Tab 4 and tab 5 after inserting the tab sheet (i.e., Tab 3) subsequent to the body text page P10. According to the conventional technique, the printing apparatus does not perform the speed switching operation between inserting the tab sheet Tab 3 and discharging the tab sheet Tab 4. In contrast, according to the control performed in the present exemplary embodiment, the printing apparatus performs the speed switching and cleaning operation as indicated by processing 1202.

However, it becomes unnecessary for the printing apparatus to switch the speed after discharging the last remaining tab sheet Tab 5 and changing to the body text P1, i.e., the first page in the (n+1)th copy. The number of speed switching operations is thus set off.

Further, according to the present exemplary embodiment, the printing apparatus performs conveyance operations of tab sheets 1203 and 1204 at the unit speed, which is different the conventional technique. Performance is thus improved with respect to the conveyance operation of tab sheets 1203 and 1204 as compared to the conventional technique.

As a result, in the case of the condition illustrated in FIG. 11 also, if the tab sheet insertion positions are not designated at both the beginning and the end of the body text, the printing apparatus ignores the setting specified on the paper type setting unit with respect to the remaining tab sheets. The printing apparatus thus performs control to operate as in the case of processing plain paper.

Third Print Sequence Example

The third print sequence example will be described below with reference to FIG. 12. According to the present example, the insertion positions of the tab sheets with respect to the body text page P1 to body text page P10 are designated previous to the body text page P1 and subsequent to the body text page P10, i.e., the final page.

Referring to FIG. 12, the printing apparatus continuously processes four tab sheets, i.e., the tab sheets Tab 3, Tab 4, Tab 5, and Tab 1. The tab sheet Tab 3 corresponds to processing 1301 subsequent to the body text page P10, the tab sheet Tab 4 and tab sheet 5 correspond to remaining tab sheet discharge operations 1302 and 1303, respectively, and the tab sheet Tab 1 corresponds to processing 1304 previous to the body text page P1. In such a case, if the printing apparatus performs control according to the conventional technique, the printing apparatus does not perform the speed switching operation.

If the printing apparatus performs control according to the present exemplary embodiment, the printing apparatus consciously performs the cleaning operation and the speed switching operation. The printing apparatus thus additionally performs the cleaning operation corresponding to processing 1305 and the speed switching operation corresponding to processing 1306.

On the other hand, if the printing apparatus performs control according to the present exemplary embodiment, the conveyance speed of the tab sheet Tab 4 corresponding to processing 1307 and the conveyance speed of the tab sheet Tab 5 corresponding to processing 1308 correspond to the conveyance speed for plain paper.

As a result, in the case of the condition illustrated in FIG. 12, the printing apparatus determines whether to perform control according to the conventional technique or switch to performing control according to the present exemplary embodiment. The printing apparatus makes such determination by comparing an increase in time in performing processing 1305 and processing 1306, and time reduced by conveying the tab sheets at the unit speed in performing processing 1307 and processing 1308.

The time necessary for switching, i.e., processing 1305 and processing 1306, depends on a model of the printing apparatus and changes according to the configuration of the printing apparatus. Further, the reduction in time by performing processing 1307 and processing 1308 depends on the number of sheets to be discharged in the remaining tab sheet discharge operation, the difference in the conveyance speeds for plain paper and a tab sheet, and the configuration of the printing apparatus.

As a result, in the case of the condition illustrated in FIG. 12, if the tab sheet insertion positions are designated at both the beginning and the end of the body text, the printing apparatus ignores the setting specified on the paper type setting unit with respect to the remaining tab sheets. Further, the printing apparatus controls whether to perform operations similar to that for plain paper as described below.

More specifically, the printing apparatus compares the increase in time in performing speed switching and the cleaning operation with the time reduced by conveying the tab sheets to be discharged at the speed corresponding to plain paper. The printing apparatus thus determines whether to ignore the setting specified in a paper type setting process and perform operations similar to processing for plain paper.

Figure 13:
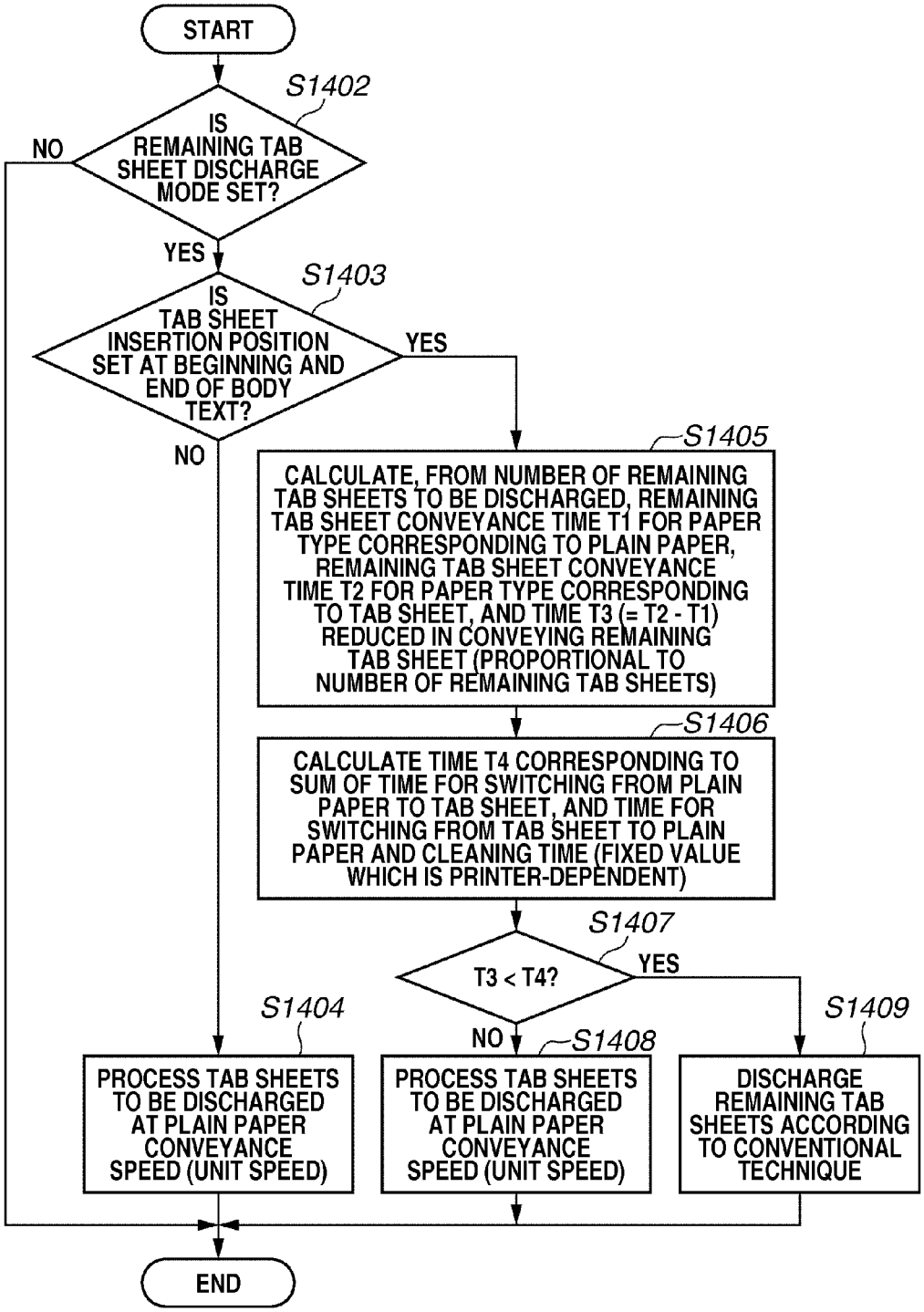
FIG. 13 is a flowchart illustrating a control method for the printing apparatus.

FIG. 13 is a flowchart illustrating the control method performed by the printing apparatus according to the present exemplary embodiment. The present example illustrates a printing process in which a plurality of copies is printed while inserting the tab sheets. Each step in the flowchart is realized by the CPU 402 illustrated in FIG. 2 loading in the DRAM 406 and executing the control program stored in the hard disk 440 or the ROM 404.

The printing process in which the printing apparatus feeds different types of paper from a plurality of paper feed cassettes will be described below. In such a case, the printing apparatus performs control to switch while performing printing, a paper feed condition so that the paper in one of the paper feed cassettes to which a printing condition is set is fed according to the print condition set to another paper feed cassette. The printing apparatus is capable of feeding from one paper feed cassette a plurality of tab sheets of different tab positions as one set. Further, the remaining tab sheets in one set, among the tab sheets used in the print job, are fed according to the print condition set to the plain paper.

In step S1402, the CPU 402 determines whether the user has set, using the UI screen displayed on the touch panel 505, a remaining tab sheet discharge mode as the operation mode. If the CPU 402 determines that the user has not set the remaining tab sheet discharge mode (NO in step S1402), the process ends.

On the other hand, if the CPU 402 determines that the user has set the remaining tab sheet discharge mode (YES in step S1402), the process proceeds to step S1403. In step S1403, the CPU 402 determines whether the insertion position of the tab sheets with respect to the body text is set at the beginning and the end of the body text.

If the CPU 402 determines that the insertion position of the tab sheets with respect to the body text is not set at the beginning and the end of the body text (NO in step S1403), the process proceeds to step S1404. In step S1404, the CPU 402 performs a process so that the sheets corresponding to the remaining tab sheets to be discharged are conveyed at the unit speed corresponding to the plain paper.

If the CPU 402 determines that the insertion position of the tab sheets with respect to the body text is set at the beginning and the end of the body text (YES in step S1403), the process proceeds to step S1405. In step S1405, the CPU 402 calculates the time reduced in conveying the sheets when the remaining tab sheets to be discharged are conveyed at the unit speed as compared to when conveyed at the ½ speed. More specifically, the CPU 402 calculates, from the number of remaining sheets to be discharged, a conveyance time T1 of the remaining tab sheets conveyed at the conveyance speed corresponding to plain paper, and a conveyance time T2 of the remaining tab sheets conveyed at the conveyance speed corresponding to the tab sheet. The CPU 402 then calculates a reduced time T3 in conveying the remaining tab sheets (i.e., T2−T1).

In step S1406, the CPU 402 calculates a time T4 from the time for switching from the plain paper to the tab sheet, the time for switching from the tab sheet to the plain paper, and the cleaning time. In step S1407, the CPU 402 compares the reduced time T3 in conveying the remaining tab sheets calculated in step S1405 with the time T4, and determines whether the reduced time T3 is shorter than the time T4. If the CPU 402 determines that the reduced time T3 in conveying the remaining tab sheets calculated in step S1405 is equal to or longer than the time T4 (NO in step S1407), the process proceeds to step S1408. In step S1408, the CPU 402 performs a process so that the sheets corresponding to the remaining tab sheets to be discharged are conveyed at the unit speed corresponding to the plain paper. The process then ends.

On the other hand, if the CPU 402 determines that the time T4 calculated in step S1406 is longer than the reduced time T3 (YES in step S1407), the process proceeds to step S1409. In step S1409, the CPU 402 performs a process so that the remaining tab sheets are conveyed at the ½ speed without switching the speed and without performing the cleaning operation. The process then ends. With the CPU 402 performing the above-described control, the print apparatus can constantly control, at optimal performance and maximum speed, discharging of the remaining tab sheets, even when the insertion positions of the tab sheets are different.

According to the first exemplary embodiment, discharging of the remaining tab sheets is described as a concrete example of the image forming process including a mixture of paper types. According to a second exemplary embodiment, functions for designating the front cover at the beginning of the body text and the back cover at the end of the body text, and an inserted-sheet function for setting the sheet to be inserted at an arbitrary position will be described as an example.

The types of paper to be set as the front cover, the back cover, and the inserted-sheet are assumed to be heavy paper or coated paper similar to the first exemplary embodiment, so that visual quality of the final product is acquired. When the printing apparatus forms images on such paper types, the printing apparatus reduces the image forming speed to the ½ speed or ⅓ speed. The printing apparatus thus forms images on a mixture of sheets in which types of paper different from the plain paper used for the body text are combined.

According to the present exemplary embodiment, the paper type setting unit is similar to that according to the first exemplary embodiment. However, according to the present exemplary embodiment, the touch panel 505 displays UI screens for the user to specify the cover and inserted-sheet settings, as illustrated in FIGS. 14A and 14B.

Figure 14A:
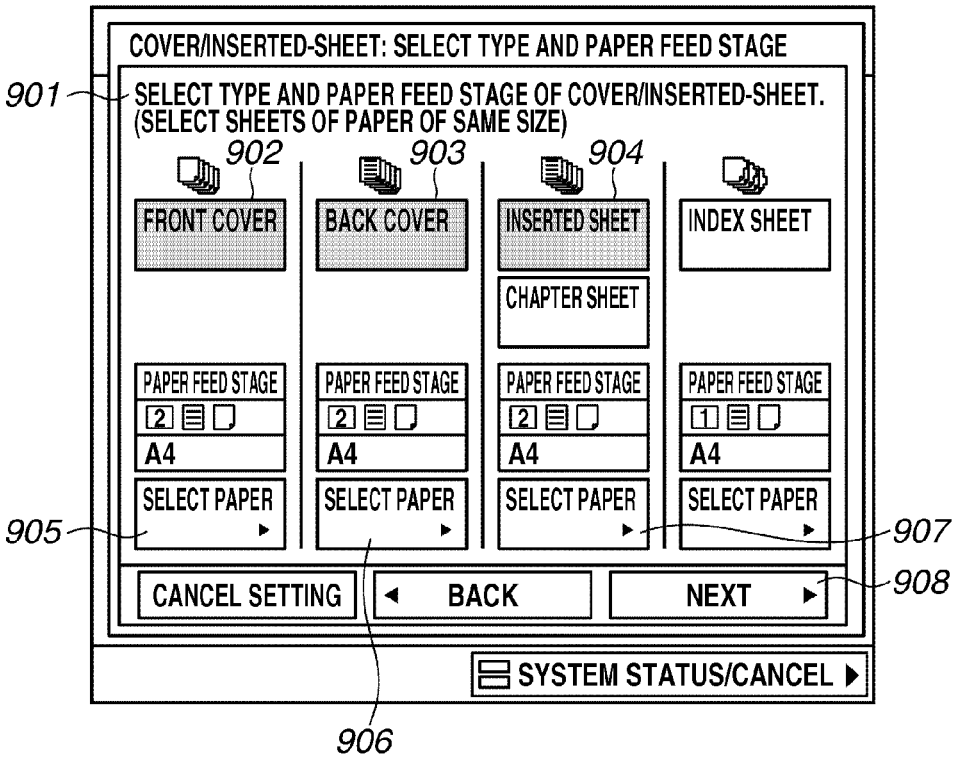
FIGS. 14A and 14B illustrate examples of UI screens displayed in the printing apparatus.
Figure 14B:
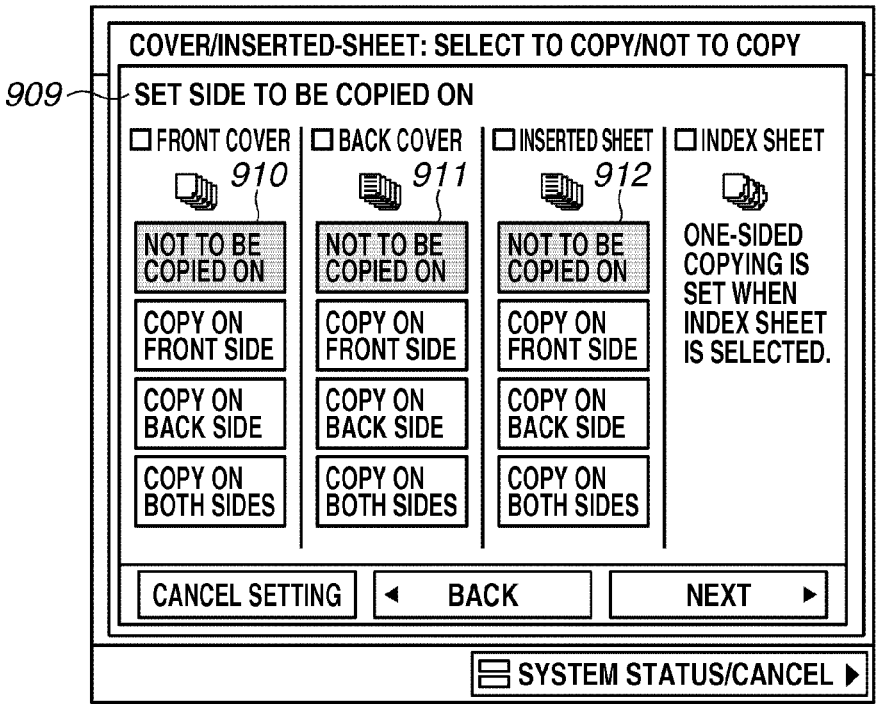

FIGS. 14A and 14B illustrate examples of the UI screens displayed on the printing apparatus according to the present exemplary embodiment. According to the present exemplary embodiment, if the user presses the application mode button 610 on the UI screen illustrated in FIG. 4, the CPU 402 displays the UI screen illustrated in FIG. 14A on the touch panel 505.

FIG. 14A illustrates a screen for setting the cover and the inserted-sheet, included in the application mode list. Referring to FIG. 14A, the user can select, via a front cover button 902 on a cover/inserted-sheet setting screen 901, whether to set the cover. Further, the user can select, via a back cover button 903, whether to set the back cover.

Furthermore, the user can select, via an inserted-sheet button 904, whether to set the inserted-sheet. The user can select, via paper feed stage buttons 905, 906, and 907, the paper feed stage with respect to each of the front cover, the back cover, and the inserted-sheet.

If the user presses a next button 908, the cover/inserted-sheet setting screen 901 jumps to a copy side selection screen 909 illustrated in FIG. 14B.

Referring to FIG. 14B, the user can select, on the copy side selection screen 909, whether to print on each of the front cover, the back cover, and the inserted-sheet, and if so, whether to print on only a front side or a back side, or on both sides. If the user sets printing, it becomes necessary for the printing apparatus to perform an optimal image forming operation for the paper type. The printing apparatus thus forms an image and performs paper conveyance control according to the paper type set via the paper type setting unit.

However, if the user selects "not to be copied on" buttons 910, 911, and 912, the CPU 402 ignores the paper types set in the paper type setting process, and performs control to operate as in the case of the plain paper, so that performance is improved. In other words, if the user selects the "not to be copied on" buttons 910, 911, and 912, the CPU 402 performs control to convey and discharge the sheets at the same conveyance speed as that for the plain paper and does not perform cleaning, regardless of the paper type.

According to the present exemplary embodiment, the printing apparatus does not perform a cleaning operation unique to tab sheets, unlike the first exemplary embodiment. As a result, a reduction effect in the print sequence time is small as compared to that according to the first exemplary embodiment. However, improvement can be realized.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-107011 filed May 12, 2011, which is hereby incorporated by reference herein in its entirety.

What is claimed is:

1. A printing apparatus comprising:

a first holding unit configured to hold sheets of a first type;

a second holding unit configured to hold sheets of a second type, wherein each of a predetermined number of sheets of the second type is grouped as one set;

a printing unit configured to print images onto the sheets of the first type and the sheets of the second type; and a control unit configured to cause included sheets, which are to be discharged with the sheets of the first type as one copy of printed materials and are among one set of the sheets of the second type, to be conveyed at a first speed, and cause one or more remaining sheet(s), which are not to be included in the one copy of printed materials and are among the one set of the sheets of the second type, to be conveyed at a second speed, wherein the second speed is faster than the first speed, and wherein the second speed is the same as a speed at which the sheets of the first type are conveyed so as not to necessitate a process for switching a conveyance speed between a sheet which is one of the sheets of the first type and a sheet which is one of the one or more remaining sheet(s), and wherein grammage of the sheets of the second type is greater than grammage of the sheets of the first type.

2. The printing apparatus according to claim 1, wherein the sheets of the second type are tab sheets.

3. The printing apparatus according to claim 1, wherein the sheets of the first type are plain sheets.

4. The printing apparatus according to claim 1, further comprising a receiving unit configured to receive the predetermined number from a user.

5. The printing apparatus according to claim 1, further comprising a cleaning unit configured to perform cleaning, wherein the cleaning unit is configured to perform the cleaning after the included sheets are conveyed, and configured not to perform the cleaning after the one or more remaining sheet(s) are conveyed.

6. A method for controlling a printing apparatus, the method comprising:

printing images onto sheets of a first type and sheets of a second type, wherein each of a predetermined number of sheets of the second type is grouped as one set; and causing included sheets, which are to be discharged with the sheets of the first type as one copy of printed materials and are among one set of the sheets of the second type, to be conveyed at a first speed, and causing one or more remaining sheet(s), which are not to be included in the one copy of printed materials and are among the one set of the sheets of the second type, to be conveyed at a second speed, wherein the second speed is faster than the first speed, and wherein the second speed is the same as a speed at which the sheets of the first type are conveyed so as not to necessitate a process for switching a conveyance speed between a sheet which is one of the sheets of the first type and a sheet which is one of the one or more remaining sheet(s), and wherein grammage of the sheets of the second type is greater than grammage of the sheets of the first type.

7. A non-transitory computer-readable storage medium storing a computer program that causes a computer to perform a method for controlling a printing apparatus, the method comprising:

printing images onto sheets of a first type and sheets of a second type, wherein each of a predetermined number of sheets of the second type is grouped as one set; and causing included sheets, which are to be discharged with the sheets of the first type as one copy of printed materials and are among one set of the sheets of the second type, to be conveyed at a first speed, and causing one or more remaining sheet(s), which are not to be included in the one copy of printed materials and are among the one set of the sheets of the second type, to be conveyed at a second speed, wherein the second speed is faster than the first speed, and wherein the second speed is the same as a speed at which the sheets of the first type are conveyed so as not to necessitate a process for switching a conveyance speed between a sheet which is one of the sheets of the first type and a sheet which is one of the one or more remaining sheet(s), and wherein grammage of the sheets of the second type is greater than grammage of the sheets of the first type.

* * * * *